US006966540B2

(12) United States Patent
Falk

(10) Patent No.: US 6,966,540 B2
(45) Date of Patent: Nov. 22, 2005

(54) PORTABLE VEHICLE LIFT

(76) Inventor: Kelly Falk, 14703 Daubern Ct., Cypress, TX (US) 77429

( * ) Notice: Subject to any disclaimer, the term of this patent is extended or adjusted under 35 U.S.C. 154(b) by 259 days.

(21) Appl. No.: 10/424,458

(22) Filed: Apr. 22, 2003

(65) Prior Publication Data

US 2005/0087728 A1 Apr. 28, 2005

Related U.S. Application Data

(60) Provisional application No. 60/399,644, filed on Jul. 31, 2002.

(51) Int. Cl.[7] ..... B66F 5/02
(52) U.S. Cl. ..... 254/2 B; 254/122
(58) Field of Search ..... 254/2 B, 122, 254/126, 7 R, 6 R, 17, 93 R, 89 H, 98, 124

(56) References Cited

U.S. PATENT DOCUMENTS

| | | | | |
|---|---|---|---|---|
| 2,546,425 A | * | 3/1951 | Broeker | 254/122 |
| 3,044,747 A | * | 7/1962 | Nolden | 254/2 B |
| 3,647,183 A | | 3/1972 | Rishoud | |
| 4,486,004 A | * | 12/1984 | Drewitz et al. | 254/2 B |
| 5,123,629 A | * | 6/1992 | Takeuchi | 254/103 |
| 5,184,930 A | | 2/1993 | Kuhn | |
| 5,484,134 A | | 1/1996 | Francis | |
| 5,911,408 A | | 6/1999 | Berends et al. | |
| 5,915,672 A | * | 6/1999 | Dickey | 254/133 R |
| 5,954,160 A | | 9/1999 | Wells, Sr. et al. | |
| 6,116,577 A | * | 9/2000 | McCanse | 254/2 B |
| D467,699 S | * | 12/2002 | King | D34/31 |
| 6,530,740 B2 | * | 3/2003 | Kim | 414/490 |
| 6,695,289 B1 | * | 2/2004 | Mickael | 254/122 |

* cited by examiner

*Primary Examiner*—Lee D. Wilson
(74) *Attorney, Agent, or Firm*—Keeling Hudson, L.L.C.; James E. Hudson, III; Kenneth A. Keeling

(57) ABSTRACT

A portable vehicle lift employed by lifting at a wheel assembly, which lift comprises a base, a stand extending vertically upward from said base, a carriage being mounted for vertical movement on a stand, a carriage further comprising a pair of arms with forwardly protruding cradle members at the bottom of arms, an engagement pad on the front of the carriage to bias the lift against the rim of the wheel assembly, and a lift mechanism for extending the combined length of the stand and the carriage. The arms may be adjustable in width to function with a variety of wheel assembly sizes. The inclusion of the engagement pad on the carriage provides contact with the wheel assembly, thereby biasing the lifting device with the tilting force due to leverage forces of the weight of the wheel assembly on the outwardly projecting cradle members. Biasing the lifting device with the engagement pad provides stability on a compact base, such that the base need not extend more than a limited distance outwardly from the front of the stand.

28 Claims, 9 Drawing Sheets

PORTABLE VEHICLE LIFT

CROSS-REFERENCE TO RELATED APPLICATIONS

This application claims the benefit of U.S. Provisional Application 60/399,644 filed Jul. 31, 2002.

STATEMENT REGARDING FEDERALLY SPONSORED RESEARCH OR DEVELOPMENT

Not Applicable.

BACKGROUND OF THE INVENTION

1. Field of the Invention

This invention relates generally to transportable lifts for automobiles, and more particularly to an apparatus for lifting a vehicle and supporting the vehicle at the lifted position.

2. Description of the Related Art

Maintenance of vehicles such as automobiles and trucks requires access to the underside of the vehicles in order to permit repair or alteration of parts, such as wheel assemblies, suspension, transmissions, brakes and the like. In order to access such areas, a mechanic will typically employ one or more lifting devices in concert or sequentially to move part or the entire vehicle to a raised position.

Once the vehicle has been raised to a desired height for access, rigid stands may be positioned beneath the vehicle to support it and the lifting devices may be removed. Such rigid stands are used because rigid stands provide better support and do not permit vertical shifting of the vehicle.

Vehicle lifts, which typically lift the vehicle frame, may create several problems. Typical lifting devices apply lifting force to the vehicle frame. Use of lifting devices may be impeded or prevented due to the location of the lifting point relative to the exterior of the vehicle as well as the clearance between the ground and the frame due to vehicle construction, vehicle suspension modification, ground effects or the like. Lifting the vehicle from a point other than an appropriate lifting point may cause damage to vehicle components. Lifting the vehicle at the frame may damage ground effects structures, which extend downward from the body to a point below the frame. It may also damage the appearance of the frame or undercarriage in cases where a pristine frame or undercarriage is desired.

As an alternative to vehicle lifts, a vehicle lift that contacts the lower portion of the tire-and-wheel assembly may be used. Lifting the vehicle from the tire-and-wheel assembly provides an additional benefit where the vehicle is particularly close to the ground and there is little space for insertion of a lifting device. Lifting the vehicle from the tire-and-wheel assembly more quickly provides additional clearance, as there is no delay while the suspension travels to its maximum deflection and requires less travel by the lifting device. Such tire-and-wheel lifting devices typically employ a fork to engage to the front and rear of the tire-and-wheel assembly, such that the tire-and-wheel assembly has relatively even pressure on both the front and rear half, so it will not have a tendency to roll off the tines of the fork.

Both such vehicle lifts may be permanently mounted or may be portable. The use of portable vehicle lifts is essential for persons performing such work outside of a professional garage. Often times portable vehicle lifts include a base too large to be inserted under a vehicle, which is close to the ground. A large base is intended to prevent the lift from tilting during vehicle lifting.

Tire-and-wheel assembly engaging vehicle lifts are known in the art. U.S. Pat. No. 5,954,160, issued to Wells, Sr., et al. on Sep. 21, 1999, discloses a tire-and-wheel assembly engaging lift for raising the entire vehicle comprising, inter alia, a pair of arms, each ending in a set of tire-and-wheel assembly engaging adapters, pivotally attached to a vertically-adjustable carriage wherein each arm may be elongated and adjusted so each fork may engage the lower exterior of the respective tire-and-wheel assembly. U.S. Pat. No. 5,911,408, issued to Berends et al. on Jun. 15, 1999, discloses a transportable lift for raising a single tire-and-wheel assembly of a vehicle, comprising, inter alia, a stand, a carriage having a set of forks attached to said stand capable of vertical movement, a base having transporting wheels and a forward extending section adjacent the forks and a means to disengage the transporting wheels. U.S. Pat. No. 5,484,134, issued to Francis on Jan. 16, 1996, discloses a vehicle lift and stand comprising, inter alia, a base having a vertical post and a forward extending section surrounding the edges of the tire-and-wheel assembly, a cylinder mounted on said vertical post with a piston and cylinder means for moving a tire-and-wheel assembly cradle, a pawl and ratchet system for restricting motion to the intended direction only, and a means to lock the carriage at a particular height comprising a pin though a hole in the post. U.S. Pat. No. 5,184,930, issued to Kuhn on Feb. 9, 1993, discloses a system for lifting a vehicle comprising, inter alia, two jacks, two carriages mounted on posts, each carriage engaging one tire-and-wheel assembly with a fork, each post having a forward extending section surrounding the edges of the tire-and-wheel assembly, and a system to power said jacks. U.S. Pat. No. 3,647,183, issued Mar. 7, 1972 to Rishovd, discloses a system for raising a vehicle comprising, inter alia, a lift member on a vertical column having teeth to engage a pawl for restricted up or down motion, a valve to drive a piston and cylinder assembly to vertical motion and a base having a forward extending section surrounding the edges of the tire-and-wheel assembly.

BRIEF SUMMARY OF THE INVENTION

The present invention overcomes shortcoming of the prior art regarding portability and use with vehicles by providing an improved portable vehicle lift without the need for a forward extending section. The invention comprises a base, a stand extending vertically upward from said base, a carriage mounted for vertical movement on said stand, said carriage further comprising a pair of adjustable arms, each having a cradle member extending outwardly, normal to the stand and carriage, and an engagement pad at the top front of said carriage for engaging said vehicle's tire-and-wheel assembly, a lifting apparatus for imparting vertical motion between said stand and said carriage, and a lift lock for fixing the vertical position of said carriage in relation to said stand. The carriage arms may be adjustable in width to function with a variety of tire-and-wheel assembly sizes. The engaging pad at the top front of said carriage provides biasing with the tire-and-wheel assembly, thereby preventing the lifting device from tilting, as vehicle weight is assumed by the lift. Engagement of the lifting pad with the tire-and-wheel assembly provides stability and, as part of a system, eliminates the need for a large base, thereby reducing the portable vehicle lift's weight and size, and making the lift operable in a greater variety of conditions.

DESCRIPTION OF THE INVENTION

Figure 1:
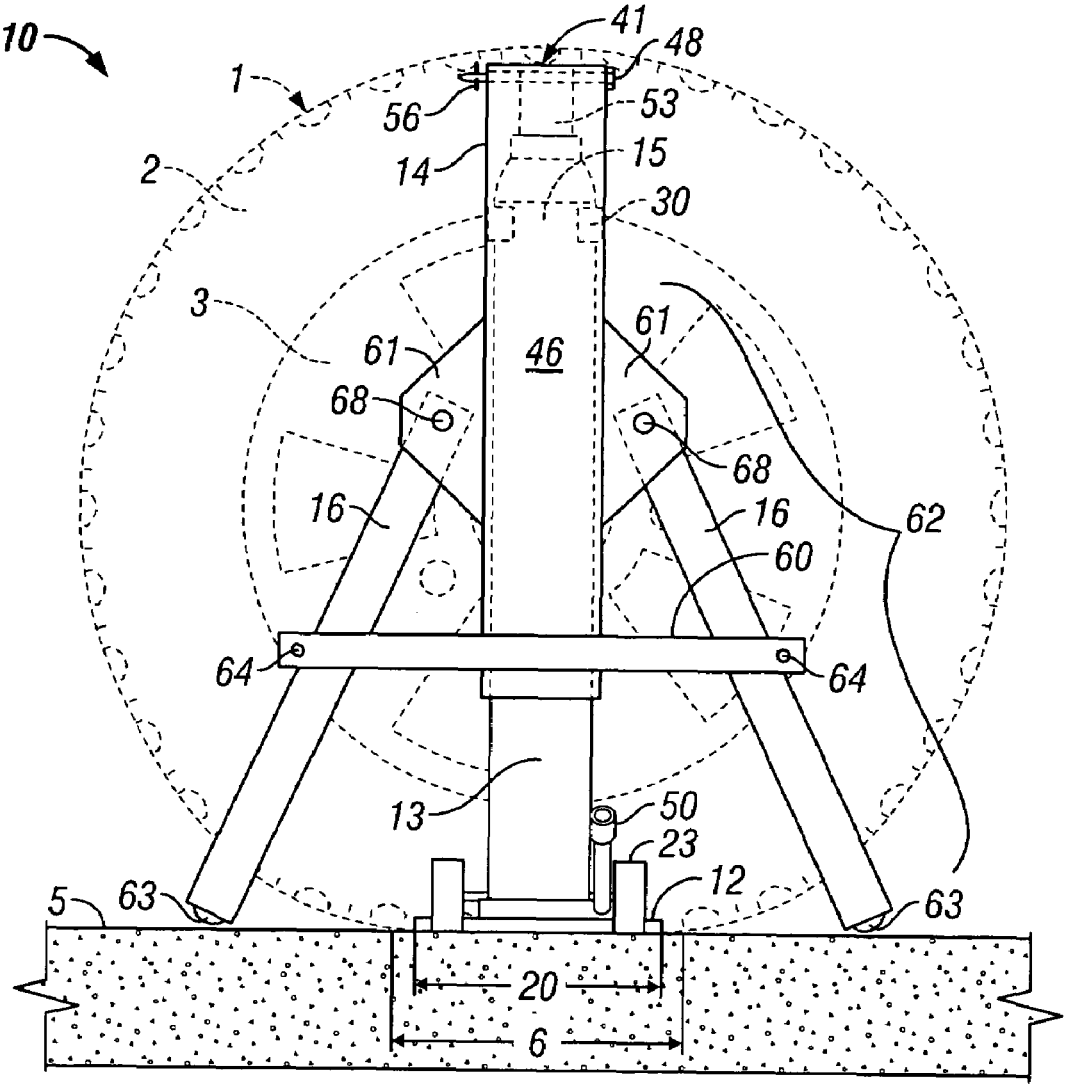
FIG. 1 is a rear view of an embodiment of the portable vehicle lift in the lowered position.

In FIGS. 1–4, a portable vehicle lift 10 according to the present invention is shown in relationship to a wheel assembly 1. Though usage of the terms tire and wheel vary in the field, for the purposes of this disclosure a wheel assembly 1 is comprised of a rigid, typically metal, central mounting structure referred to as a rim 3, which in most cases has mounted thereon a tire 2. The portion of wheel assembly 1 that comes in contact with the surface upon which the wheel assembly sits is the contact area 6. Contact area 6 extends from the inside to the outside of wheel assembly 1, and extends a partial distance to the circumferential front and to rear wheel assembly 1.

Portable vehicle lift 10 comprises a base 12 of sufficient area to support the load to be lifted by lift 10. In most instances the use location will have a solid or hard packed surface, suitable for vehicular traffic. As such, the area required by base 12 can be similar to conventional vehicular jacks. The area of base 12 is defined by the length of base width 20 and the length of base depth 21. The combination of base width 20 and base depth 21 are sufficient to provide an adequate area for lifting the weight of a portion of a vehicle without lift 10 sinking into surface 5 when carrying the intended portion of a vehicular weight carried by wheel 1.

A stand 13 extends upward from base 12. Stand 13 attaches to base 12 to restrict motion between stand 13 and base 12 while weight is applied. In the exemplary embodiment, base 12 is fixed to stand 13, and base 12 is rectangular, occupying only a slightly larger area than the bottom end of stand 13.

Figure 5:
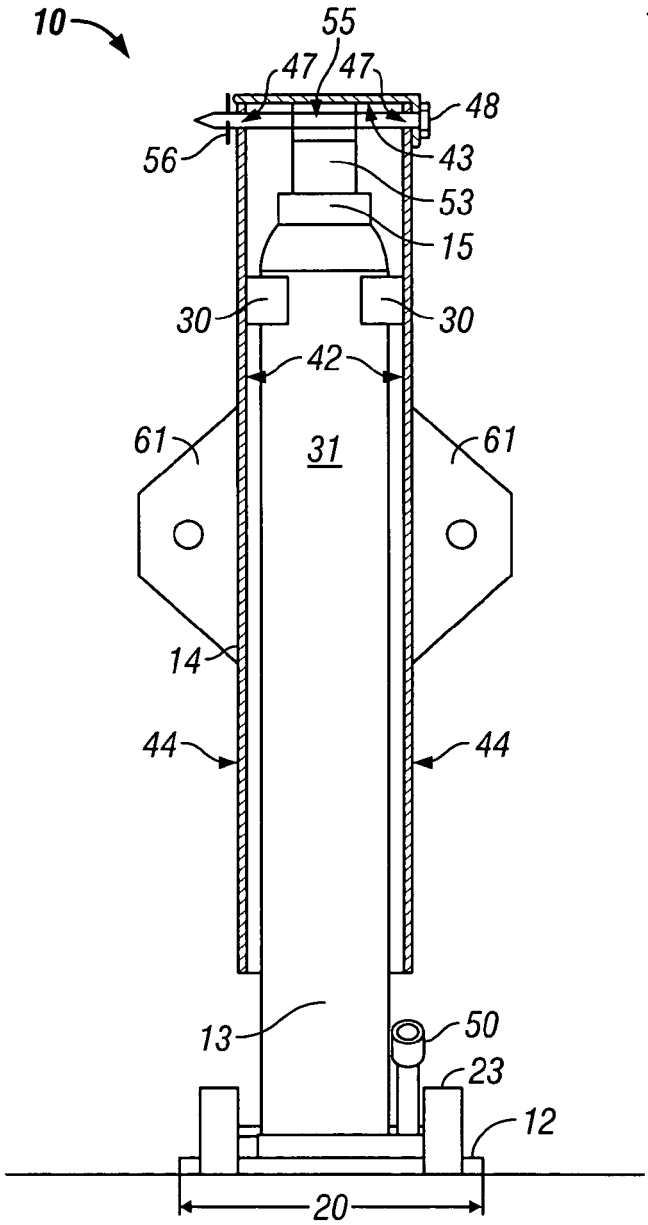
FIG. 5 is a segment of a partially cut-away rear view of the vehicle lift of FIG. 1, with the lifting apparatus in an extended position.
Figure 6:
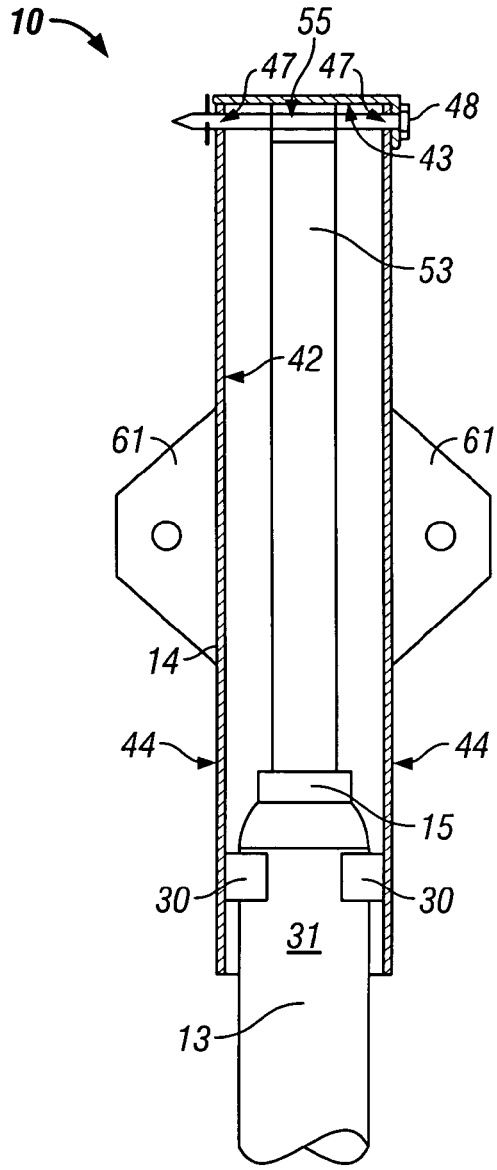
FIG. 6 is a rear view of the lift of FIG. 1, in a raised position.

A carriage 14 is mounted to stand 13 for vertical movement on stand 13. Referring to FIGS. 5 and 6, stand 13 possesses a lift mechanism 15, which may be selective operated to extend the combined length of stand 13 and carriage 14. In the exemplary embodiment, carriage 14 is a sleeve structure that surrounds part of stand 13 from the end opposite base 12. Additionally, exemplary stand 13 is a hydraulic drive cylinder, having a cylindrical drive housing 31 and a drive rod 53. Exemplary carriage 14 has a square cross-sectional shape, with an interior width slightly greater than the cross-sectional diameter of stand 13. Stand 13 has guide blocks 30 affixed to the outside surface of stand 13, directly between stand 13 and carriage interior wall 42. Guide blocks 30 are positioned to provide a stable relationship between the position of stand 13 and carriage 14. The exemplary embodiment has four guide blocks 30 oriented at the corners of carriage interior wall 42, and shaped to fill the void between the round shape of stand 13 and the square shape of carriage 14.

Referring to FIGS. 1–4, carriage 14 has a front 45, a back 46, a top 41 and two opposing carriage sides 44. Carriage top 41 is located distal base 12. Carriage front 45 is the face of carriage 14 intended to be closest to wheel 1 during operation. The opposing face to carriage front 45 is referred to as carriage back 46. The opposing faces connecting front 45 to back 46 are carriage sides 44.

Figure 2:
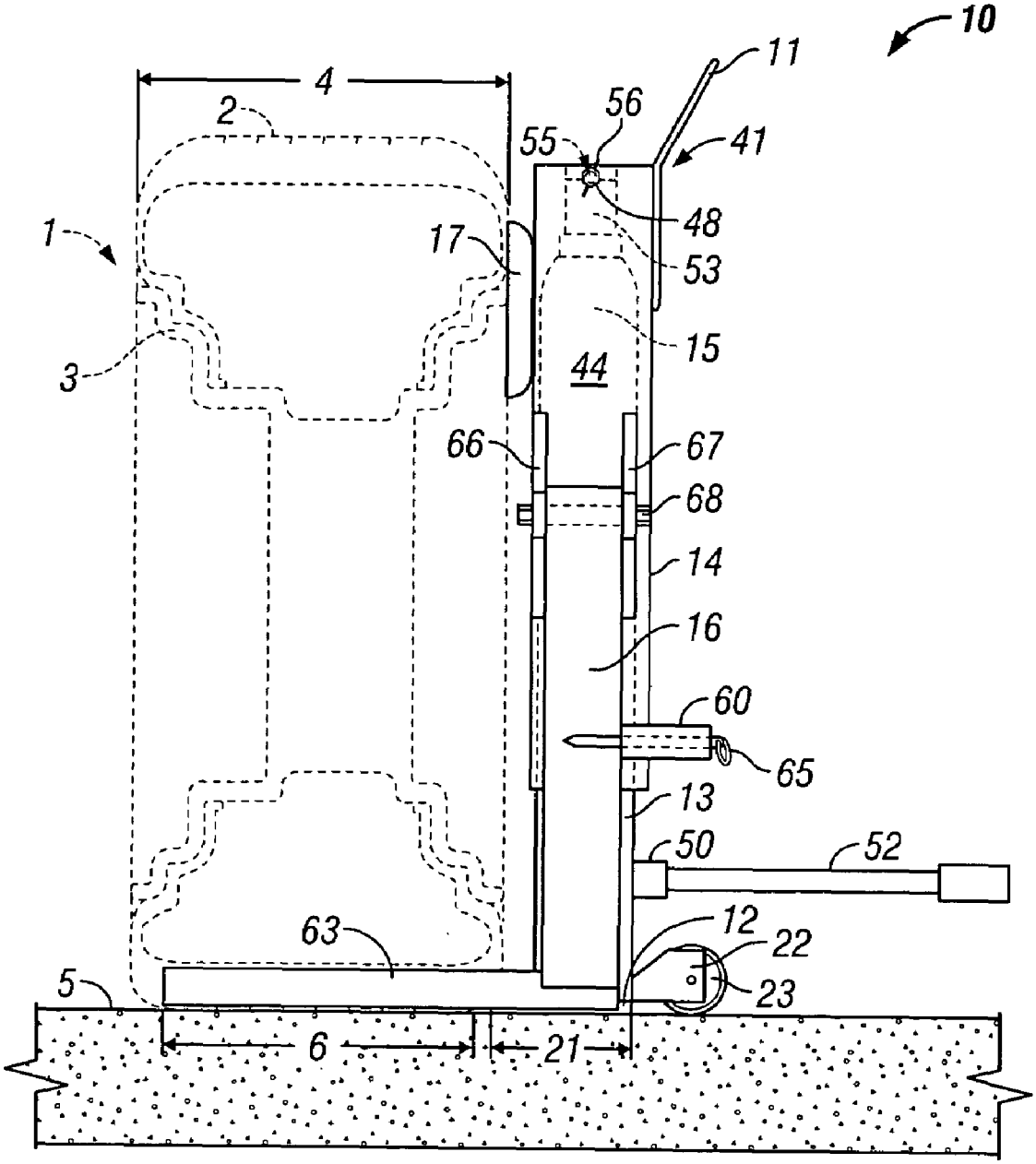
FIG. 2 is a side view of an embodiment of the portable vehicle lift in the lowered position.
Figure 3:
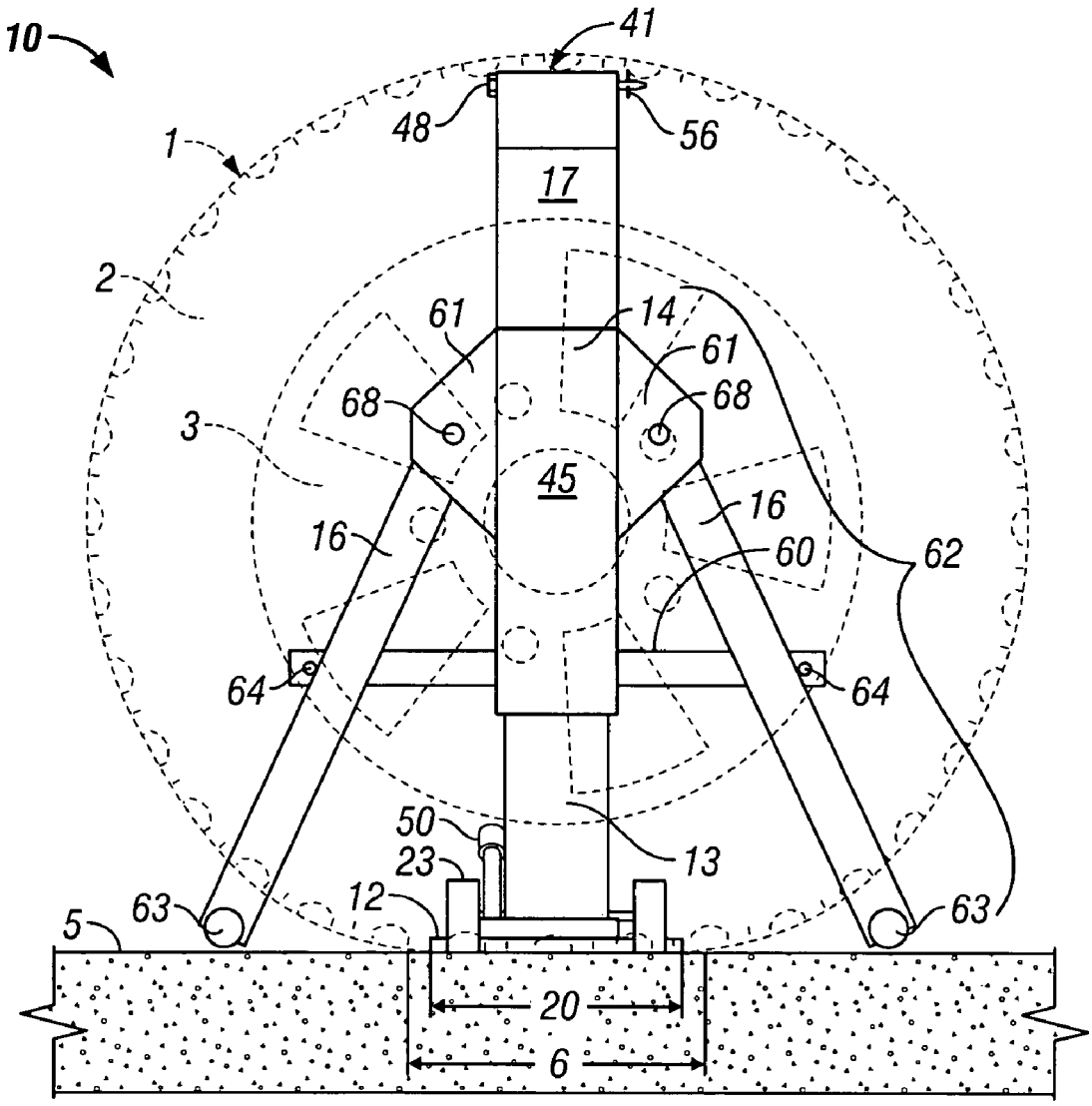
FIG. 3 is a front view of the lift of FIG. 1.
Figure 4:
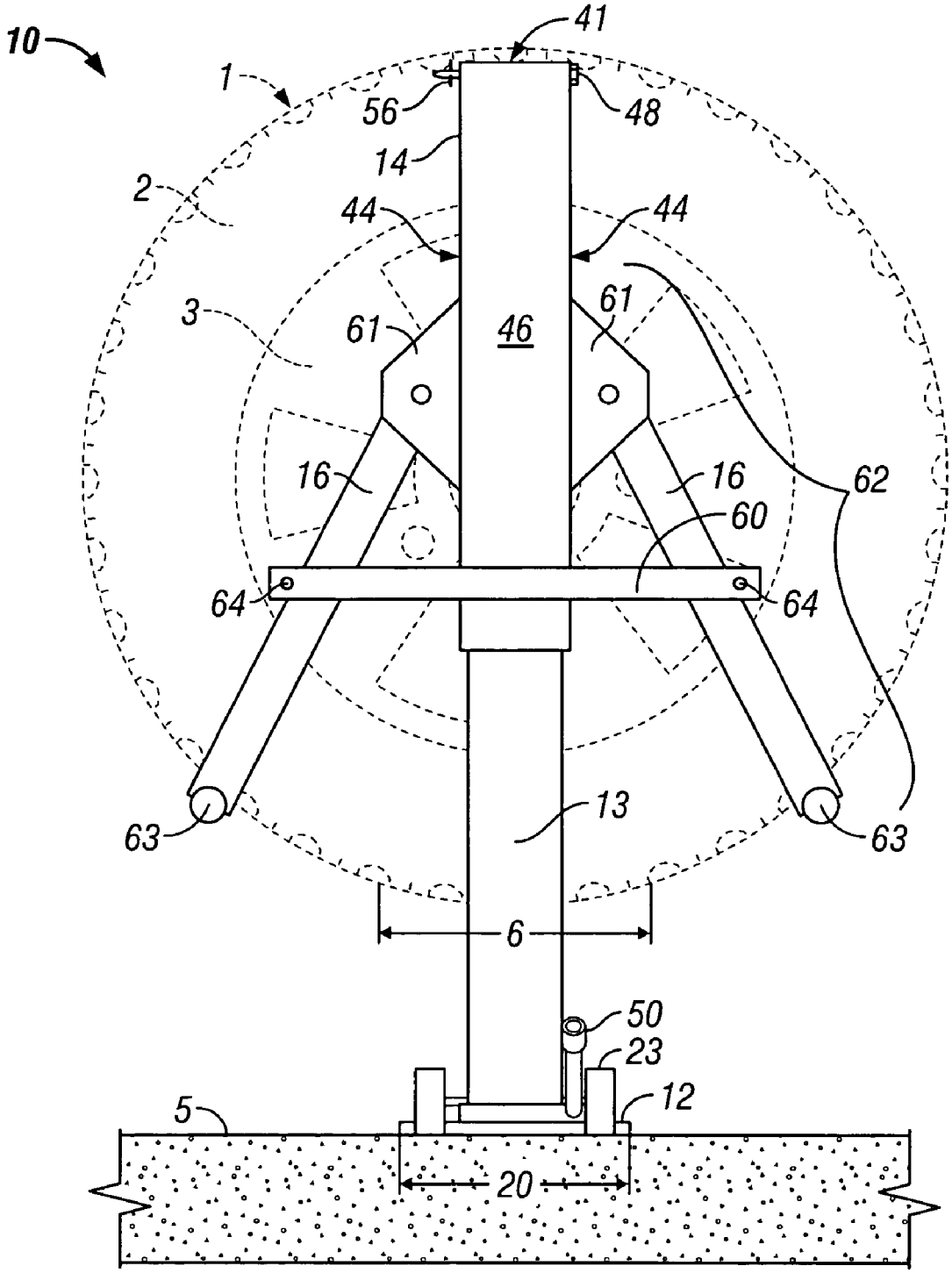
FIG. 4 is a partially cut-away rear view of the vehicle lift of FIG. 1.

Affixed to carriage front 45 is an engagement pad 17 for interfacing with a wheel 1 to be lifted. Engagement pad 17 is positioned on carriage front 45 such that when lift 10 is in a lowered position, shown in FIGS. 1–3 and 5, and positioned adjacent to wheel 1, engagement pad 17 comes in contact with rim 3. The extent to which base depth 21 extends outwardly from lift 10 is limited so as to permit the positioning of engagement pad 17 in contact with rim 3 when lift 10 is positioned adjacent to wheel 1 for use. Engagement pad 17 is constructed of a dense, resilient, non-abrasive material. In the exemplary embodiment, engagement pad 17 contacts rim 3 at the upper end near the interface of rim 3 and tire 2, as shown in FIG. 2. In the exemplary embodiment engagement pad 17 is rubber.

The area immediately adjacent to lift 10 on the side of carriage front 45 is wheel receiving space 7. Wheel receiving space 7 has the physical dimensions of a wheel assembly 1 upon which lift 10 may be applied. The face of engagement pad 17 distal carriage 14 defines the closest plane of the wheel receiving space 7.

Base 12 may extend a short distance outwardly from vehicle lift 10 toward wheel receiving space 7, however, base 12 does not encroach on wheel receiving space 7. Engagement pad 17 may extend a short distance outwardly from carriage 14 toward wheel receiving space 7. The distance to which base 12 extends toward the front of lift 10 does not essentially exceed the distance to which pad 17 extends toward the front.

In the exemplary embodiment of FIG. 2, a handle 11 is shown affixed to carriage back 46 adjacent carriage top 41. Referring to FIGS. 1–5, on the side of base 12 corresponding with carriage back 46 are wheels 23, attached by wheel mounts 22. In the exemplary embodiment there are two wheels 23 in order to provide appropriate stability to lift 10 when tilted by handle 11 onto wheels 23.

Referring to FIGS. 1–4, carriage 14 further comprises a wheel-engaging adapter 62. Wheel-engaging adapter 62 is positioned to be proximate wheel receiving space 7 in order to support a wheel assembly 1 from the bottom. In the exemplary embodiment, wheel-engaging adapter 62 is formed by a pair of arms 16, one on each carriage side 44, which arms 16 are hingedly attached to carriage sides 44 at one end by arm mounts 61, such that arms 16 may be positioned at angles to stand 13 within a movement path ranging from parallel in a downward position to parallel in an upward position. Exemplary arm mounts 61 are comprised of front hinge plate 66, back hinge plate 67 and hinge pin 68, as seen in FIG. 2. Each exemplary arm 16 has a cradle member 63. Cradle members 63 are attached to exemplary arms 16 distal to arm mounts 61, and extend outwardly from carriage front 45, and perpendicular to carriage front 45. In the exemplary embodiment, cradle members 63 are rigidly fixed to arms 16. In an alternate embodiment (not shown), cradle members 63 may be hingedly attached to arms 16 in order to provide for folded storage against arms 16. The distance between cradle members 63 and engagement pad 17 must be of appropriate length so that during operation of lift 10 engagement pad 17 contacts rim 3 while each of cradle members 63 are in contact with the rolling surface at opposing sides of contact area 6 of wheel assembly 1.

The length of contact area 6 is determined by a particular wheel assembly 1. A larger diameter wheel assembly 1 has a longer contact area 6 and a wider wheel assembly 1 has a wider contact area 6. Arms 16 may be of sufficient length to accommodate a variety of wheel assembly 1 sizes. Cradle members 63 may be of sufficient length to accommodate a variety of wheel assembly depths 4.

Arms 16 abut backing bar 26, which is permanently mounted to carriage 14 below the level of arm mounts 61. Backing bar 26 has generally horizontal backing bar holes 64, through which backing bar pins 65 may be inserted to extend into the movement path of hinged arms 16, limiting the upward and outward movement of arms 16. Backing bar 26 attaches to carriage 14, extending outwardly normal to carriage 14, immediately adjacent the movement paths of arms 16. Backing bar 26 may provide lateral support to arms 16, such that arms 16 are reinforced against forces that would push arms 16 laterally past carriage back 46. In the exemplary embodiment, backing bar 26 is permanently attached coplanar to carriage back 46, extending outwardly beyond each carriage side 44.

Lift mechanism 15 may be configured using various types of lifting mechanisms known to the field to apply extending force between stand 13 and carriage 14. The exemplary lift mechanism 15, emphasized in FIGS. 5 and 6, employs a hydraulic drive cylinder having the drive housing 31 integrated into stand 13. Drive rod 53 protrudes from the end of stand 13 distal base 12 to contact carriage top interior 43. The protruding portion of drive rod 53 has a rod hole 55, which is alignable with rod pin holes 47 in each carriage side 44, distal base 12. Rod pin 48 is provided to extend through rod pin holes 47 and rod hole 55 securing drive rod 53 to carriage 14. Rod pin 48 is retained in rod pin holes 47 and rod hole 55 by a cotter pin 56 or other means known to the field.

In the exemplary embodiment, lift mechanism 15 has a lift actuator 50, which cooperatively operates with a lift lever 52. Lift lever 52 extends outwardly from stand 13 from the face corresponding to carriage back 46.

Figure 8:
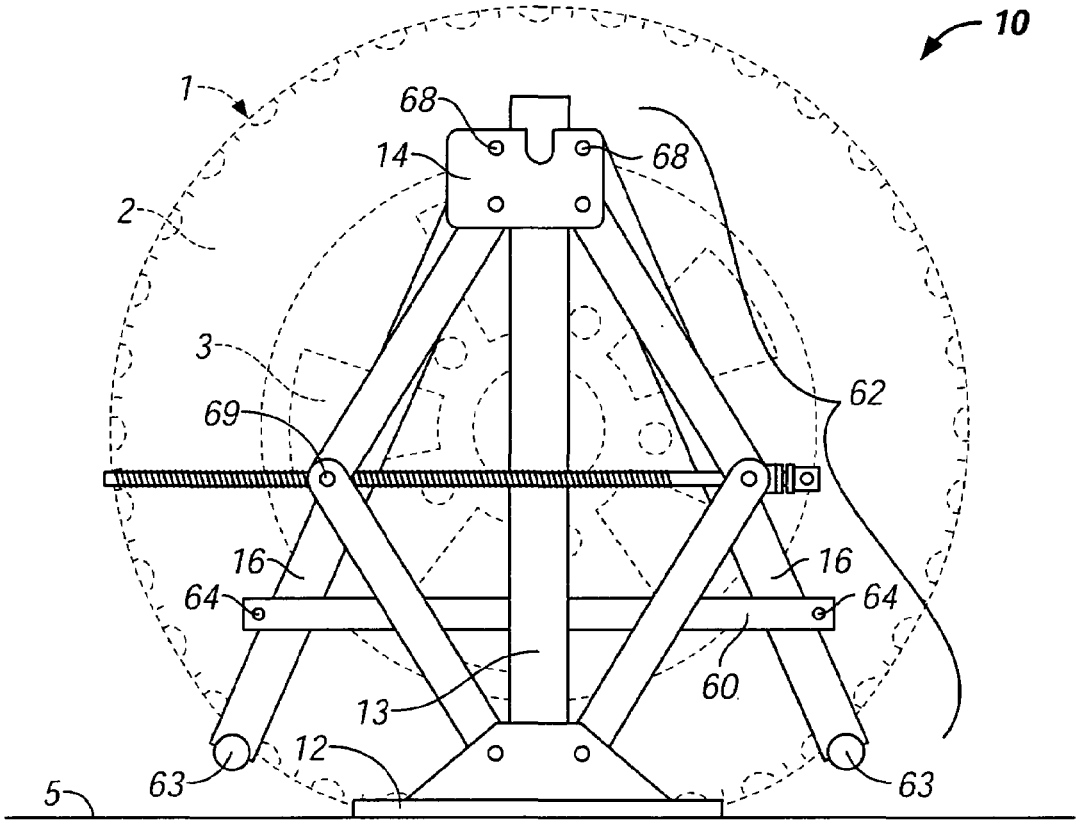
FIG. 8 is a view of an alternate embodiment of the portable vehicle lift having a scissor jack as the lifting mechanism.
Figure 9:
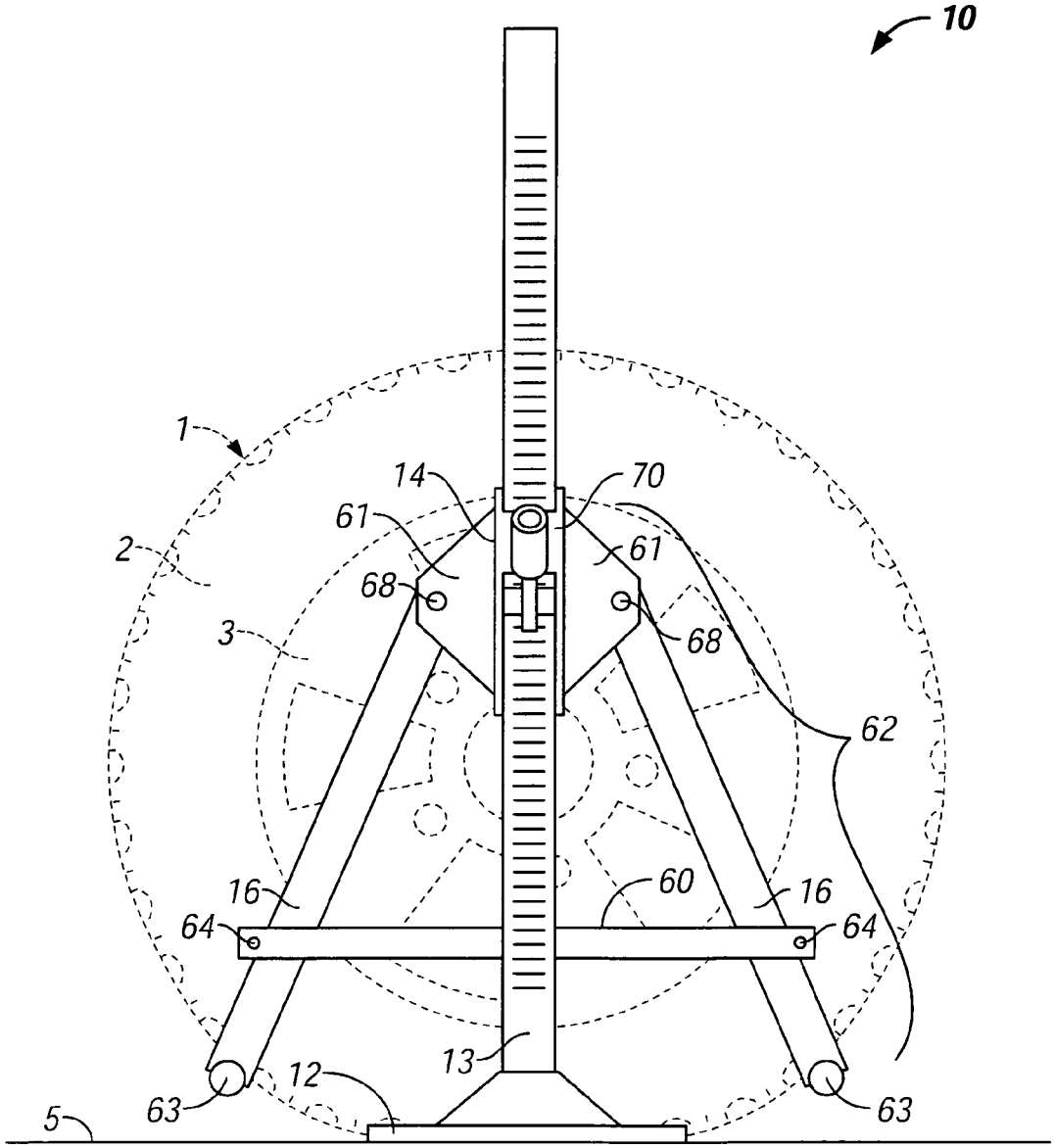
FIG. 9 is a view of an alternate embodiment of the portable vehicle lift having a pawl and ratchet device as the lifting mechanism.
Figure 10:
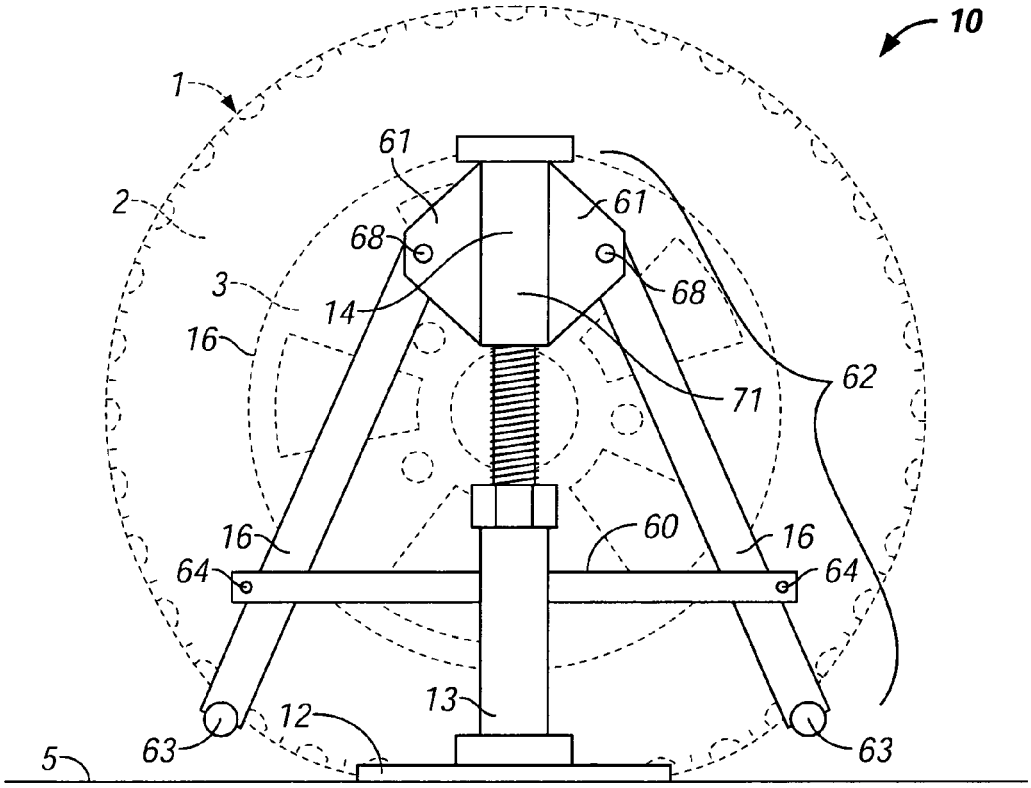
FIG. 10 is a view of an alternate embodiment of the portable vehicle lift having a screw jack as the lifting mechanism.

Alternatively, the hydraulic drive cylinder may be external to the stand. Alternative types of lifting mechanisms 15 include screw configurations 71 as depicted in FIG. 10, scissors configurations 69 as depicted in FIG. 8, and pawl-and-ratchet jack configurations 70 as depicted in FIG. 9, which would apply separating force between stand 13 and carriage 14.

Figure 7:
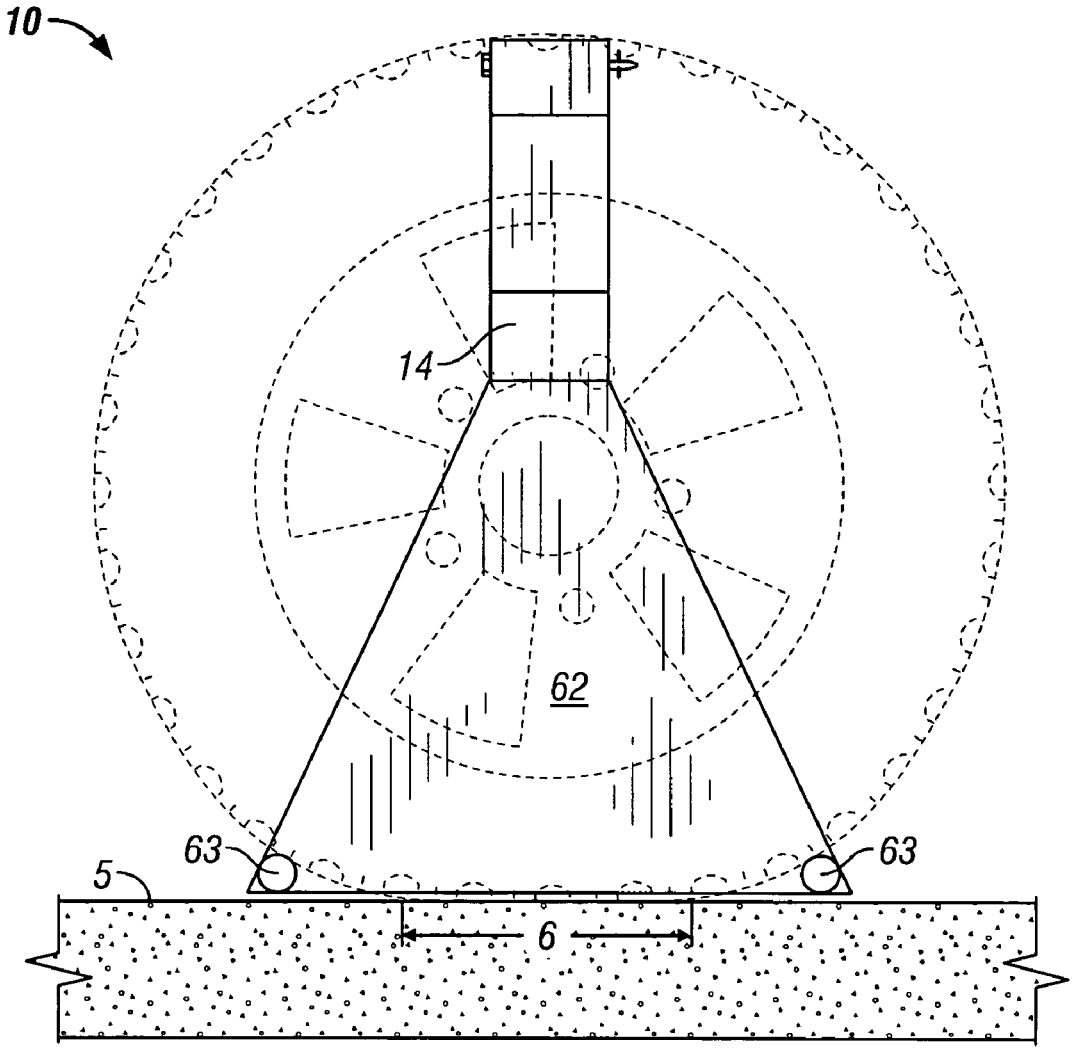
FIG. 7 is a front view of an alternate embodiment of the portable vehicle lift.

Referring to FIG. 7, an alternate exemplary embodiment of vehicle lift 10 has an alternate configuration of wheel-engaging adapter 62. Arm 16 is comprised of a single piece fixed to carriage front 45. Cradle members 63 are attached to the opposite ends of exemplary arm 16 from engagement pad 17, and extend outward from the carriage front 45 and perpendicular to the carriage front 45. The distance between cradle members 63 and engagement pad 17 must permit engagement pad 17 to contact rim 3 while cradle members 63 are in contact with the underside of wheel assembly 1.

Referring generally to FIGS. 1–6, in operation, a user manipulates portable vehicle lift 10 into the lowered position, with carriage 14 lowered close to base 12, arms 16 angled slightly away from stand 13 and cradle members 63 proximate to solid surface 5. In this lowered position, lift 10 is moved adjacent wheel assembly 1, with carriage front 45 facing wheel assembly 1. Lift 10 is oriented with base 12 positioned on solid surface 5, adjacent to the contact area 6 of wheel assembly 1, and engagement pad 17 in contact with rim 3. Cradle members 63 extend under opposing sides of wheel assembly 1.

The distance to which base 12 extends toward the front of lift 10 does not essentially exceed the distance to which pad 17 extends toward the front. As such, pad 17 will not extend past the vertical plane of a wheel assembly 1, upon which lift 10 is acting, and base 12 will not extend under said wheel assembly 1, or around said wheel assembly 1 and under a vehicle (not shown) upon which said wheel assembly 1 is mounted.

To raise wheel assembly 1 and a part of the weight of a vehicle (not shown) attached thereto, lift mechanism 15 is operated to extend the combined length of stand 13 and carriage 14. In the exemplary embodiment, lift lever 52 is pumped upward and downward to move lift actuator 50 in a similar fashion, but with more mechanical advantage. Lift actuator 50 causes drive rod 54 to extend from the top of stand 13 and push against top interior 43 of carriage 14, causing carriage 14 to extend linearly above stand 13.

The upward motion of carriage 14 forces upward motion in arm mounts 61, arms 16 and cradle members 63. As cradle members 63 travel upward, they contact and push upward against wheel assembly 1. The weight of wheel assembly 1 and its accompanying vehicle (not shown) and the friction of the roadway surface of wheel assembly 1 against cradle members 63 fix arms 16 at the current angles in relationship to sides 44. As lift mechanism 15 further extends the combined length of stand 13 and carriage 14 wheel assembly 1 is lifted off solid surface 5. As the weight of wheel assembly 1, being displaced away from the body of lift 10, applies leverage forces on lift 10 such that the top of lift 10 pushes toward wheel assembly 1. Engagement pad 17 is biased by the force of torque against solid rim 3 and the force of the weight on base 12. The biasing forces cause lift 10 to maintain a stable upright position. With the exemplary embodiment, engaging pad 17 is biased against rim 3 and not excessively against tire 2, since engagement of exemplary engaging pad 17 exclusively with tire 2 may result in sufficient force against the side of tire 2 to deform tire 2 to the point of breaking the bead between tire 2 and rim 3.

Lift mechanism 15 is raised until wheel assembly 1 reaches the desired height, after which time a stationary stand (not shown) may be placed under wheel assembly 1, the axle upon which wheel assembly 1 is mounted or under an appropriate support point of a vehicle upon which wheel assembly 1 is mounted. Once a stationary stand is in place, lift mechanism 15 may be reversed to reduce the combined length of stand 13 and carriage 14, taking the weight of wheel assembly 1 off lift 10. Then lift 10 may be removed from its location adjacent to wheel assembly 1. The lifting process may be repeated for multiple wheel assemblies 1 of a single vehicle.

To lower the vehicle or individual wheel assembly 1, vehicle lift 10 is manipulated into a raised position, where cradle members 63 are at a level lower than the bottom surface of the fore and aft portions of wheel assembly 1. Lift 10 is again place immediately adjacent wheel assembly 1, such that cradle members 63 are centered fore and aft of wheel assembly 1. Lift mechanism 15 is operated to raise cradle members 63 to contact wheel assembly 1, and for engagement pad 17 to engage rim 3. Lift mechanism 15 is operated to extend the combined length of stand 13 and carriage 14 until the weight of wheel assembly 1 is on lift 10 and stationary stands are free from the weight of the vehicle.

At this point stationary stands may be removed and lift mechanism 15 may be reversed, such that operation of lift mechanism 15 reduces the combined length of stand 13 and carriage 14. This motion may be continued until the entire weight of wheel assembly 1 is supported by solid surface 5, and lift 10 no longer supports any of the weight of wheel assembly 1 or its accompanying vehicle (not shown). Lift 10 may then be removed from its location adjacent to wheel assembly 1.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A portable vehicle lift for lifting a vehicle having a wheel assembly including a
wheel rim, said lift comprising;
a vertically-elongated stand;
a carriage supported on said stand;
said carriage vertically movable relative to said stand;
said carriage having a carriage front;
a wheel engagement pad on said carriage front;
at least two elongated cradle members extending outwardly from said carriage front;
said engagement pad above said at least two cradle members; and
a lifting mechanism for raising and lowering said carriage relative to said stand.

2. The portable vehicle lift of claim 1 further comprising:
said stand having a stand front and a stand bottom;
said stand having a base attached to said stand bottom;
a wheel receiving space adjacent said stand front; and
said base not encroaching said wheel receiving space.

3. The portable vehicle lift of claim 2 further comprising:
said at least two cradle members each connected to said carriage by a carriage arm; and
each said carriage arm angularly adjustable in relation to said carriage.

4. The portable vehicle lift of claim 3 further comprising:
each said carriage arm hingedly connected to said carriage at a carriage arm first end; and
each said carriage arm having a cradle member extending from a carriage arm second end.

5. The portable vehicle lift of claim 1 further comprising:
said carriage having carriage sides and a backing bar;
each said carriage arm having a movement path; and
said backing bar extending outwardly from said carriage normal to said carriage sides and immediately adjacent said movement paths.

6. The portable vehicle lift of claim 5 further comprising:
a plurality of bar holes provided in said backing bar; and
a plurality of backing bar pins, each bar pin insertable through a determined bar hole into said movement path of a corresponding said carriage arm.

7. The portable vehicle lift of claim 1 further comprising:
said carriage including an elongated vertical cavity;
said carriage positioned on said stand with said stand accessing said elongated cavity;
said carriage slideable on said stand;
said carriage having a lowered position;
said stand having a lower end; and
said cradle member positioned adjacent said lower end of said stand when said carriage is in said lowered position.

8. The portable vehicle lift of claim 7 further comprising:
said stand including a hydraulic drive;
said hydraulic drive comprising a vertically-oriented hydraulic cylinder and a drive rod; and
said drive rod operable to raise and lower said carriage.

9. The portable vehicle lift of claim 1 further comprising:
said stand having a stand back;
said stand having a stand base; and
at least two wheels on said stand base proximate said stand back.

10. The portable vehicle lift of claim 1 further comprising:
said carriage having a lowered position;
each said cradle member of said sufficient length to a variety of wheel assembly widths;
said stand having a lower end; and
each said cradle member positioned adjacent said lower end of said stand when said carriage is in said lowered position.

11. The portable vehicle lift of claim 1 further comprising:
said lifting mechanism comprising a screw jack.

12. The portable vehicle lift of claim 1 further comprising:
said lifting mechanism comprising a scissors jack.

13. The portable vehicle lift of claim 1 further comprising:
said lifting mechanism comprising a pawl and ratchet device.

14. A portable vehicle lift for lifting a vehicle having a wheel assembly including a wheel rim, said lift comprising:
a vertically-elongated stand and a carriage said vertically-elongated stand having a front;
said vertically-elongated stand centered about a single axis;
said carriage supported on said stand;
said carriage vertically movable relative to said stand;
said carriage having a carriage front said front of said vertically-elongated stand not extending beyond said carriage front;
an engagement pad and a wheel-engaging adapter positioned at said carriage front;
said wheel-engagement adapter engagable with said wheel assembly to lift said wheel assembly;
said stand and said carriage operable between a lowered position and a raised position;
said lowered position wherein said wheel-engaging adapter proximate a surface; and
said raised position wherein said wheel-engaging adapter distal said surface.

15. The portable vehicle lift of claim 14 further comprising:
said engagement pad extending outwardly a pad distance from said carriage front;
said stand having a stand front;
said stand having a base for distributing said lifted weight on said surface;
said base extending outwardly from said stand front a base distance; and
said base distance not significantly exceeding said pad distance.

16. The portable vehicle lift of claim 14 further comprising:
said wheel-engaging adapter having at least two cradle members.

17. The portable vehicle lift of claim 16 further comprising:

each said cradle member extending outwardly from said carriage front.

18. The portable vehicle lift of claim 14 further comprising:

said carriage having two sides adjacent and perpendicular to said front;

said wheel-engaging adapter comprising two arms;

said arms attached to respective said sides; and each said arm having a cradle member extending outwardly from said carriage front.

19. The portable vehicle lift of claim 18 wherein:

said arms hingedly attached to said carriage at attachment points.

20. The portable vehicle lift of claim 19 further comprising:

a carriage back opposite said carriage front; and a backing bar attached to said carriage at said carriage back intermediate said attachment points and said base, and extending outwardly from said sides, perpendicular to said stand.

21. The portable vehicle lift of claim 20 further comprising:

said backing bar having a pin hole at each end distal said stand providing passageway through said backing bar from said carriage back to said carriage front; and a pin insertable through and securable in each said pin hole to selectively restrict movement of said arms about said hinges.

22. The portable vehicle lift of claim 14 further comprising:

said stand having a vertical lifting mechanism.

23. The portable vehicle lift of claim 22 further comprising:

said stand and said carriage having a combined length; and said vertical lifting mechanism selectively operational to vary said combined length.

24. The portable vehicle lift of claim 22 wherein said vertical lifting mechanism comprising:

a hydraulic drive cylinder.

25. The portable vehicle lift of claim 22 wherein said vertical lifting mechanism comprising:

a screw jack.

26. The portable vehicle lift of claim 22 wherein said vertical lifting mechanism comprising:

a scissors jack.

27. The portable vehicle lift of claim 22 wherein said vertical lifting mechanism comprising:

a pawl and ratchet device.

28. The portable vehicle lift of claim 14 wherein said wheel-engaging adapter comprising:

at least two cradle members.

* * * * *